US008123037B2

(12) United States Patent
Lee et al.

(10) Patent No.: US 8,123,037 B2
(45) Date of Patent: Feb. 28, 2012

(54) CHILD-RESISTANT MEDICATE CONTAINER

(75) Inventors: Richard M. Lee, Volcano, CA (US); Thomas Guschke, Palm Beach Gardens, FL (US)

(73) Assignee: Juno Technologies, LLC, Palm Beach Gardens, FL (US)

( * ) Notice: Subject to any disclaimer, the term of this patent is extended or adjusted under 35 U.S.C. 154(b) by 26 days.

(21) Appl. No.: 12/823,238

(22) Filed: Jun. 25, 2010

(65) Prior Publication Data

US 2011/0000814 A1 Jan. 6, 2011

Related U.S. Application Data

(60) Provisional application No. 61/223,281, filed on Jul. 6, 2009.

(51) Int. Cl.
*B65D 83/04* (2006.01)
*B65D 55/02* (2006.01)

(52) U.S. Cl. ..... 206/536; 221/306

(58) Field of Classification Search ..... 220/8, 324, 220/326; 221/65, 306, 154; 206/242–276, 206/811, 528–540; 222/519, 153.14, 522; 215/212

See application file for complete search history.

(56) References Cited

U.S. PATENT DOCUMENTS

| | | | |
|---|---|---|---|
| 349,761 | A | 9/1886 | Stebbins |
| 409,029 | A | 8/1889 | Elliott |
| 792,104 | A | 6/1905 | Woerner |
| 2,086,534 | A | 7/1937 | Byrne |
| 2,103,520 | A | 12/1937 | Donnelly |
| 2,172,547 | A | 9/1939 | Ruth |
| 2,353,629 | A | 7/1944 | Apfelbaum |
| 2,426,911 | A | 9/1947 | Williamson |
| 2,492,864 | A | 12/1949 | Hermani |
| 2,580,096 | A | 12/1951 | Holt et al. |
| 2,631,763 | A | 3/1953 | Sutton |
| D174,300 | S | 3/1955 | Waterman |
| 3,058,586 | A | 10/1962 | Touart |
| 3,095,085 | A | 6/1963 | Meijer |
| 3,286,872 | A | 11/1966 | Burdick, Jr. |
| 3,305,145 | A | 2/1967 | Tebbutt |
| 3,355,067 | A | 11/1967 | Espinal |
| 3,678,884 | A | 7/1972 | Robbins |
| 3,788,517 | A | 1/1974 | Eannarino et al. |
| 3,863,804 | A | 2/1975 | Infante-Diaz et al. |
| 3,872,996 | A | 3/1975 | Dogliotti |
| 3,877,573 | A | 4/1975 | Scott et al. |
| 3,889,847 | A | 6/1975 | Uroshevich et al. |
| D238,469 | S | 1/1976 | Lanois |
| 4,113,098 | A | 9/1978 | Howard |

(Continued)

*Primary Examiner* — Mickey Yu
*Assistant Examiner* — Chun Cheung
(74) *Attorney, Agent, or Firm* — Panitch Schwarze Belisario & Nadel LLP

(57) ABSTRACT

A child-resistant medicate container includes a housing having a top segment fixedly attached to and extending from a bottom segment. Each of the bottom segment and the top segment include a generally flat first sidewall and an opposing generally flat second sidewall that define the storage cavity. Each sidewall defines a plane and each plane extends generally parallel with respect to the remaining planes. The planes defined by the first and second sidewalls of the bottom segment are spaced-apart a greater distance than a distance between the planes defined by the first and second sidewalls of the top segment. A cover is movably attached to the housing and surrounds at least a portion of the first and second sidewalls of the top segment of the housing. One of the cover and the top segment of the housing include an aperture formed in a sidewall thereof.

2 Claims, 7 Drawing Sheets

U.S. PATENT DOCUMENTS

D249,931 S 10/1978 Russert
D249,932 S 10/1978 Russert
4,126,224 A 11/1978 Laauwe et al.
4,154,353 A 5/1979 Hoo
4,231,378 A 11/1980 Stevens
4,483,095 A 11/1984 Webinger
D278,207 S 4/1985 McLaughlin
4,561,544 A 12/1985 Reeve
4,591,074 A 5/1986 Kennings
D286,506 S 11/1986 Poore et al.
D298,512 S 11/1988 Gotlib
4,893,728 A 1/1990 Jennings et al.
4,971,203 A 11/1990 Weinstein
5,080,222 A 1/1992 McNary
5,080,227 A 1/1992 Focke
5,082,137 A 1/1992 Weinstein
D324,175 S 2/1992 Beck
5,099,999 A 3/1992 Balien
5,141,129 A 8/1992 Jennings
5,169,003 A * 12/1992 Traupman ..... 206/524.8
D332,347 S 1/1993 Raadt et al.
5,275,291 A 1/1994 Sledge
5,285,897 A 2/1994 Ozaki
5,405,011 A 4/1995 Haber et al.
5,405,047 A 4/1995 Hansen
5,427,265 A * 6/1995 Cautereels et al. ..... 220/318
D364,344 S 11/1995 Shaw
D375,455 S 11/1996 Uhl et al.
5,579,933 A 12/1996 Hofmann
5,709,306 A 1/1998 Hofmann
5,718,347 A 2/1998 Walker et al.
5,947,345 A 9/1999 Hofmann
6,095,364 A 8/2000 Dickie et al.
D453,680 S 2/2002 Grintz et al.
D485,754 S 1/2004 Fielder et al.
6,672,471 B2 1/2004 Cross
6,953,131 B2 10/2005 Devine
D513,584 S 1/2006 Solowiejko et al.
D523,171 S 6/2006 Mitten et al.
D523,743 S 6/2006 Solowiejko et al.
D526,761 S 8/2006 Hoffman
7,140,511 B2 11/2006 Baker et al.
D542,661 S 5/2007 Adler et al.
D545,186 S 6/2007 Liebe et al.
D549,573 S 8/2007 Liebe et al.
D554,990 S 11/2007 Terrasi
7,311,205 B2 12/2007 Adler et al.
D568,736 S 5/2008 Born et al.
7,413,082 B2 8/2008 Adler et al.
D594,742 S 6/2009 Meier et al.
D598,295 S 8/2009 Miceli et al.
D607,320 S 1/2010 Tearle
D614,025 S 4/2010 Paredes et al.
7,708,142 B2 5/2010 Ehrlund
D616,753 S 6/2010 Beam et al.
7,757,843 B2 7/2010 Katsis
D627,222 S 11/2010 Oravez et al.
2007/0284277 A1 12/2007 Gnepper
2008/0011761 A1 1/2008 Gnepper et al.
2009/0266837 A1 10/2009 Gelardi et al.
2011/0000931 A1 1/2011 Gelardi et al.
2011/0067363 A1 3/2011 Sprada et al.

* cited by examiner

CHILD-RESISTANT MEDICATE CONTAINER

CROSS-REFERENCE TO RELATED APPLICATIONS

The present application claims priority to U.S. Provisional Patent Application No. 61/223,281, filed Jul. 6, 2009 and entitled "Child-Resistant Medicate Container and Method of Shipping and Filling Same."

BACKGROUND OF THE INVENTION

The present invention relates to a child-resistant medicate container and, more specifically, to a child-resistant medicate container that is configured to store pharmaceutical products, such a pills, capsules, tablets and/or liquid medicine, that is sized and shaped for ease of shipping, packaging and/or transporting one or more containers in a relatively thin, flat-rate package.

Many pharmaceutical products, such as pills, capsules, tablets and/or liquid medicine, are packaged in child-resistant medicate containers having a generally cylindrical base or housing with an open first end and an opposite closed second end. A cap or cover is generally rotatably mounted to the open end of the base and typically requires the user to perform a distinct finger and/or hand motion to remove the cap from the base. Unfortunately, conventional containers have several drawbacks. For example, the shape of generally cylindrical and/or circular child-resistant medicate containers makes it difficult to ship, package and/or transport multiple containers in a single package. The costs of shipping and/or transporting the containers increases as the number or size of the packages increases. In addition, specifically-designed packaging is necessary to properly hold the conventional medicate containers and often results in unused or wasted space within the packaging. Further, due to the shape of conventional child-resistant medicate containers, information labels can be difficult to properly apply to the base and/or cap. Furthermore, since conventional child-resistant medicate containers include two separable parts (i.e., the base and the cap), problems arise when a user inadvertently misplaces one of these components.

Therefore, it would be desirable to create a child-resistant medicate container that eliminates the above-identified deficiencies of conventional child-resistant medicate containers. Specifically, it would be desirable to create a child-resistant medicate container that is generally flat and/or rectangular in shape such that multiple containers can be easily and/or conveniently placed inside a flat-rate box and/or packaging from a carrier without wasting space. Further, it would be desirable to create a child-resistant medicate container having substantially planer and/or flat surfaces, such that various labels can be easily and/or conveniently applied thereto. Furthermore, it would be desirable to create a child-resistant medicate container for holding and/or dispensing pharmaceutical products, in which the various components of the container cannot easily be separated and/or removed from each other once the container is assembled.

BRIEF SUMMARY OF THE INVENTION

Briefly stated, the present invention is directed to a child-resistant medicate container for holding and dispensing at least one pharmaceutical product. The container includes a housing having an open first end and an opposing closed second end. The housing at least partially encloses a storage cavity. The housing includes a top segment fixedly attached to and extending from a bottom segment. A portion of the bottom segment is located proximate the closed second end of the housing and a portion of the top segment is located proximate the open first end of the housing. Each of the bottom segment and the top segment include a generally flat first sidewall and an opposing generally flat second sidewall that define the storage cavity. Each sidewall defines a plane and each plane extends generally parallel with respect to the remaining planes. The planes defined by the first and second sidewalls of the bottom segment are spaced-apart a greater distance than a distance between the planes defined by the first and second sidewalls of the top segment. A cover is movably attached to the housing and surrounds at least a portion of the first and second sidewalls of the top segment of the housing. One of the cover and the top segment of the housing include an aperture formed in a sidewall thereof. The cover is movable between a first position in which the aperture is substantially blocked to prevent the at least one pharmaceutical product from being dispensed from the container and a second position in which the aperture is at least partially open to allow the at least one pharmaceutical product to be dispensed from the container.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 2:
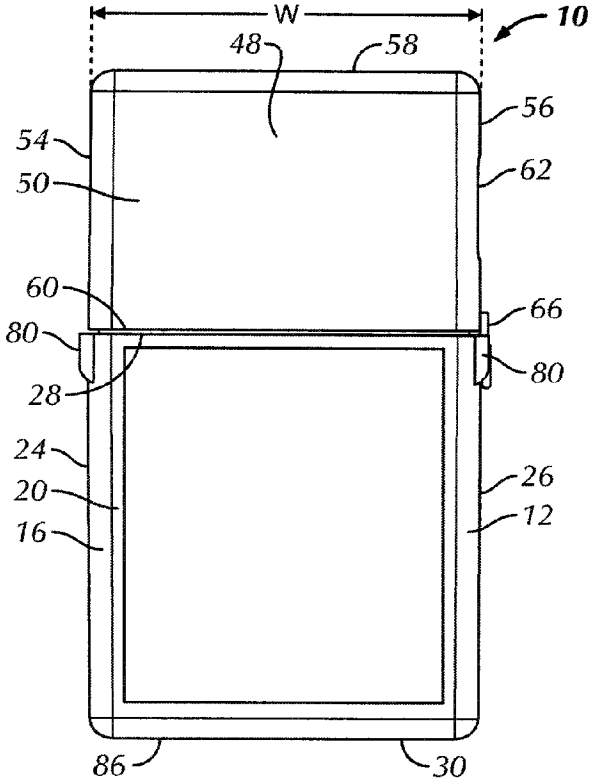
FIG. 2 is an front elevation view of the child-resistant medicate container shown in FIG. 1, with the cover in the first or storage position.

Certain terminology is used in the following description for convenience only and is not limiting. The words "right," "left," "lower" and "upper" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the container and designated parts thereof. Additionally, the term "a" and "an," as used in the specification, mean "at least one." The terminology includes the words above specifically mentioned, derivatives thereof, and words of similar import.

Referring to the drawings and detail, wherein like numerals indicate like elements throughout, there is shown in FIGS. 1-9 a first preferred embodiment of a child-resistant medicate container, generally designated 10 and hereinafter referred to as the "container" 10 in accordance with the present invention. The container 10 is preferably sized and shaped to hold, store, transport and/or dispense pharmaceutical products, such as pills, tablets, capsules and/or liquid medicine or the like. Although the container 10 is preferably generally resistant to being opened by a child, as described in detail below, it is understood by those skilled in the art that the container 10 is not so limited, and may simply be a container designed to be openable by a user of any age.

Those of ordinary skill in the art will appreciate from this disclosure that the item(s) and/or contents to be held within the container 10 can be something other than the pills, tablets, capsules and/or liquid discussed above. For example, granular pharmaceuticals, contact lenses suspended in liquid, dental implant components (i.e., screws, inserts, etc.), small hardware and/or electronic parts, cosmetics or similar items potentially hazardous to children or adults can be safely contained in a relatively accessible and convenient manner using the container 10 of the present invention. Likewise, candies, breath mints or any relatively small item generally needing singular dispensing may be stored within the container 10. Thus, the container 10 can be used to contain other contents without departing from the spirit and scope of the present invention.

The container 10 is preferably formed of a high-strength, light-weight material, such as an opaque, translucent, amber or transparent die-formable polymeric material. For example, the container 10 may be formed of polypropylene, polyethylene terephthalate, polycarbonate, acrylic and styrene. However, a wide variety of materials, including but not limited to metals, such as aluminum and stainless steel may be used without departing from the scope and spirit of the invention. To preserve and/or protect the at least one item stored inside the container 10, the material used to form the container 10 is also preferably generally impenetrable and/or resistant to ultraviolet (U.V.) light.

Referring to FIGS. 1-9, the container 10 preferably includes a housing 12, having a generally flat or rectangular parallepiped shape, that at least partially encloses a storage cavity 14 to hold the pharmaceutical product(s). Preferably, the housing 12 has first, second, third, and fourth corners, each of which have a generally arcuate shape and a generally equal radius of curvature. Those of ordinary skill in the art understand that the generally rectangular or square shape of the container 10 is more efficient for shipping/transporting and automated manufacturing than cylindrical or circular containers. The generally flat or rectangular shape of the container 10 is also more efficient than conventional vials for automated dispensing and handling using robotics and/or automated machines/equipment like A-frames and remote dispensing cabinets, for example. Further, with pre-counted quantities, the container 10 is more efficient for prescription filling because it eliminates the need for the pharmacy technician or pharmacist to hand-count the medicates, which is one of the major labor components in regular prescription fulfillment. The housing 12 preferably includes an open first end 84 and an opposing closed second end 86.

Figure 6:
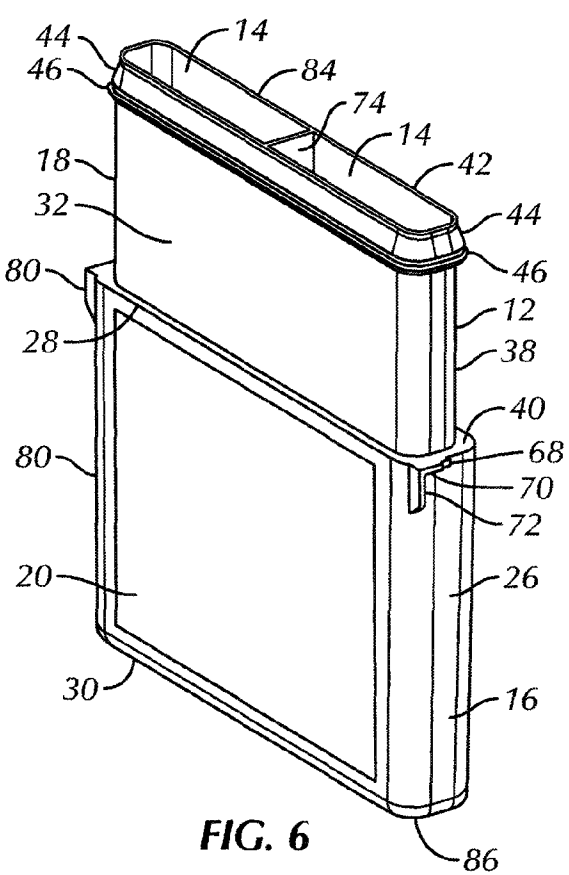
FIG. 6 is a perspective view of a housing of the child-resistant medicate container shown in FIG. 1.
Figure 5:
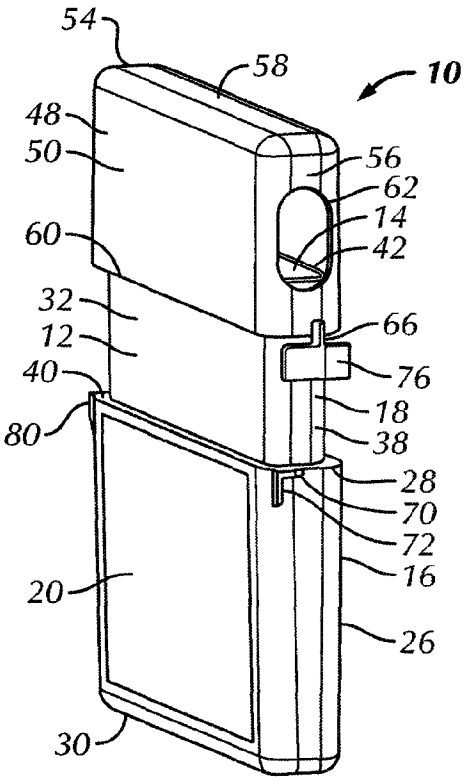
FIG. 5 is a perspective view of the child-resistant medicate container shown in FIG. 1, with the cover in a second or dispensing position.

The housing 12 includes a base or bottom segment 16 preferably fixedly attached to and integral with an insert or top segment 18. The base segment 16 includes a front sidewall 20, an opposing rear sidewall 22, a right sidewall 24 and an opposing left sidewall 26. In the preferred embodiment, the front and rear sidewalls 20, 22 are generally planer or flat along an entire width thereof and define two spaced-apart and generally parallel planes. The right and left sidewalls 24, 26 are preferably generally concave in shape along their width and define two spaced-apart and generally parallel planes. However, as seen in FIGS. 5 and 6, a central portion or midpoint of the right and left sidewalls 24, 26 may include a generally flat or planar portion. Thus, the right and left sidewalls 24, 26 extend generally perpendicularly to the front and rear sidewalls 20, 22. Further, the base segment 16 includes a first end 28 and an opposing closed second or bottom end 30. The bottom end 30 of the base segment 16 is the same surface as the closed second end 86 of the housing 12.

In the present embodiment, the flat, rectangular shape of the front and rear sidewalls 20, 22 are ideal for receiving one or more labels (not shown). For example, the front sidewall 20 may receive a label concerning the type of product held within the container 10 and/or an advertisement or the like, and the rear sidewall 22 may receive a label concerning patient-specific information, such as dosage rates or the like.

Figure 3:
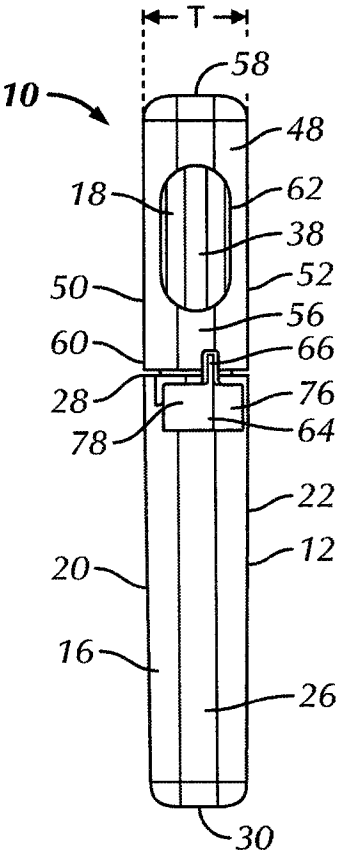
FIG. 3 is a left side elevation view of the child-resistant medicate container shown in FIG. 1, with the cover in the first or storage position.

As seen in FIG. 3, an exterior surface of the front and rear sidewalls 20, 22 of the base segment 16 define a maximum thickness "T" of the container 10. In the present embodiment, the maximum thickness "T" of the container 10, as measured from the exterior surface of the front sidewall 20 of the base segment 16 to the exterior surface of the rear sidewall 22 of the base segment 16, is preferably less than one half (½) inch. This dimensioning is necessary to assure that the container 10 fits in certain sized flat-rate packages. However, it is understood by those of ordinary skill in the art that the container 10 is not limited to this exact dimensioning.

Figure 8:
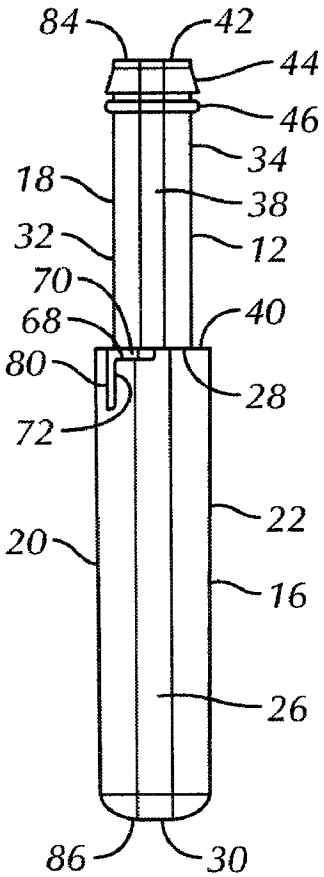
FIG. 8 is a left side elevation view of the housing shown in FIG. 6.

Referring to FIGS. 3-8, the insert segment 18 preferably extends from and is integrally formed with and/or fixedly attached to the first end 28 of the base segment 16. Similar to the base segment 16, the insert segment 18 includes a front sidewall 32, an opposing rear sidewall 34, a right sidewall 36 and an opposing left sidewall 38. Similar to the base segment 16, the front and rear sidewalls 32, 34 of the insert segment 18 are generally planer or flat along an entire width thereof and define two-spaced apart and generally parallel planes. However, as seen in FIGS. 5, 6 and 8, the generally vertical planes defined by the front and rear sidewalls 32, 34 of the insert segment 18 are generally closer to each other than the planes defined by the front and rear sidewalls 20, 22 of the base segment 16, such that a ledge or lip 40 is defined generally at the first end 28 of the base segment 16 or the point at which the insert segment 18 adjoins the base segment 16.

Furthermore, the right and left sidewalls 36, 38 of the insert segment 18 are generally concave in shape across a width thereof and generally define two spaced-apart and generally parallel planes. However, as seen in FIGS. 5 and 6, a central portion or midpoint of the right and left sidewalls 36, 38 may include a generally flat or planar portion. Thus, the right and left sidewalls 36, 38 of the insert segment 18 generally extend perpendicularly to the front and rear sidewalls 32, 34 of the insert segment 18, similar to the sidewalls of the base segment 16. Further, a first or top end 42 of the insert segment 18 is generally open and provides access to the storage cavity 14 of the container 10.

Figure 7:
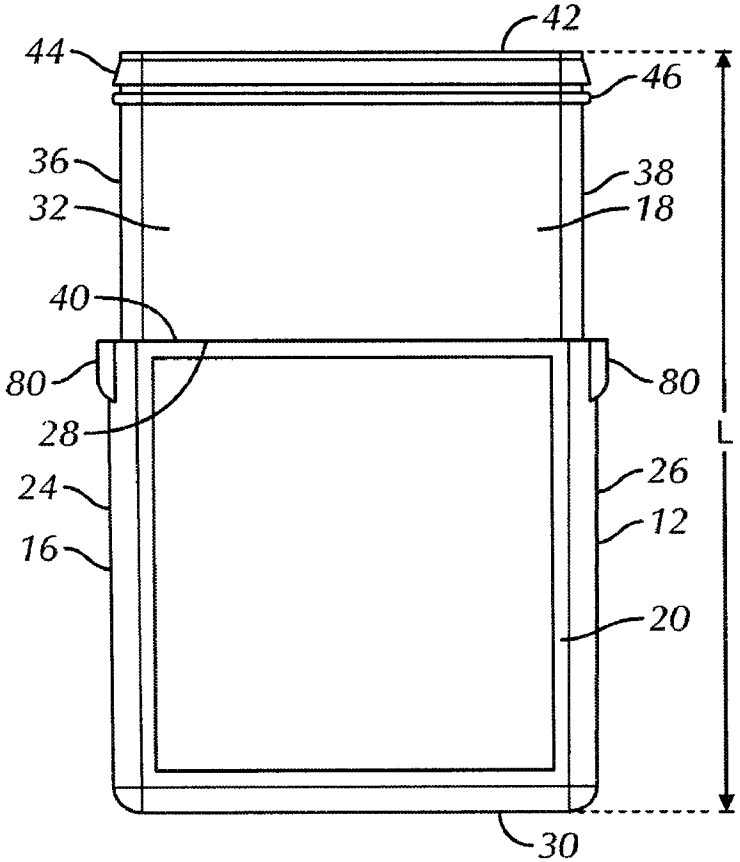
FIG. 7 is a front elevation view of the housing shown in FIG. 6.

Referring to FIGS. 6-8, the first end 42 of the insert segment 18 preferably includes a protuberance or catch 44, at least a portion of which extends generally perpendicularly outwardly from at least one of the sidewalls 32, 34, 36, 38 of the insert segment 18. The protuberance 44 is preferably molded to, and thus integral with, the insert segment 18. Preferably, the protuberance 44 generally defines an increasingly sloped surface extending away from the first end 42 of the insert segment 18 and extends circumferentially around an entire outer periphery of the insert segment 18. In one preferred embodiment of the present invention, an elastomeric member 46, such as an O-ring, preferably extends around the entire outer periphery of the insert segment 18 adjacent to or below the protuberance 44. Preferably, the elastomeric member 46 is fixedly attached, such as by being elastically biased, to each sidewall 32, 34, 36, 38 of the insert segment 18, but is understood that the elastomeric member 46 may be omitted or removably mounted to the insert segment 18.

Figure 1:
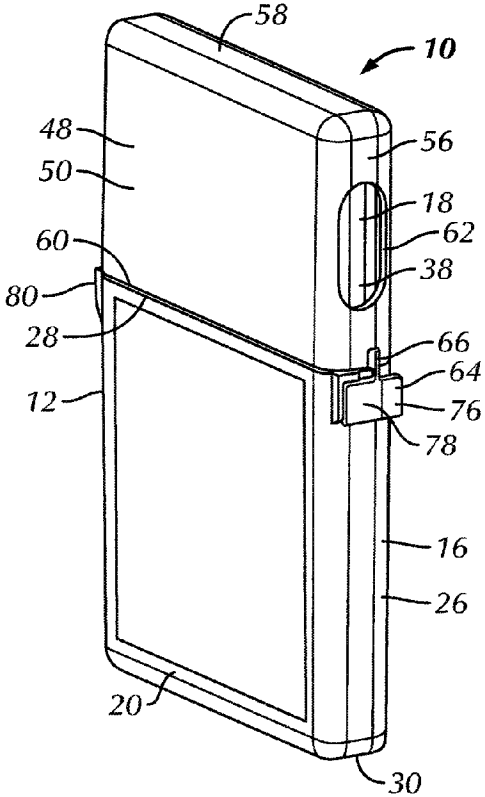
FIG. 1 is a perspective view of a child-resistant medicate container in accordance with a first preferred embodiment of the present invention, with a cover of the container shown in a first or storage position.
Figure 4:
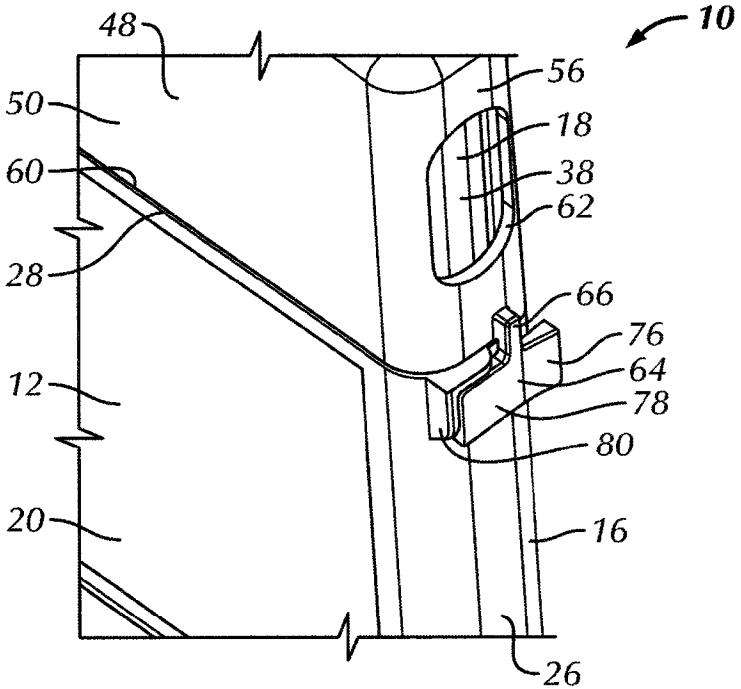
FIG. 4 is a magnified perspective view of a portion of the child-resistant medicate container shown in FIG. 1, with the cover in the first or storage position.

Referring to FIGS. 1-5, the container 10 preferably includes a cap or cover 48 movably attached to the housing 12. In the preferred embodiment, the cover 48 surrounds and/or encloses at least a portion of the insert segment 18, such as the first end 42 of the insert segment 18. As will be described in detail below, the cover 48 is slidably, but preferably not removably, mounted to the insert segment 18. Thus, the container 10 includes less pieces for a user or consumer to misplace or loose. Similar to the base and insert segments 16, 18, the cover 48 includes a front sidewall 50, an opposing rear sidewall 52, a right sidewall 54, and an opposing left sidewall 56. Similar to the base and insert segments 16, 18, the front and rear sidewalls 50, 52 of the cover 48 are generally flat or planer in shape across an entire width thereof and define two spaced-apart and generally parallel planes. The right and left sidewalls 54, 56 of the cover 48 are generally concave along an entire width thereof. However, as seen in FIGS. 1, 4 and 5, a central portion or midpoint of the right and left sidewalls 54, 56 may include a generally flat or planar portion. The right and left sidewalls 54, 56 of the cover 48 extend generally perpendicularly to the front and rear sidewalls 50, 52 of the cover 48. The cover 48 further includes a first or top closed end 58 and an opposite second or bottom open end 60.

As seen in FIG. 7, a maximum length "L" of the container 10 is generally defined from the first end 42 of the insert segment 18 or first end 58 of the cover 48 (when the container 10 is in the first or storage position) to the bottom end 30 of the base segment 16. It is understood by those skilled in the art that since the top end 58 and sidewalls 50, 52, 54, 56 of the cover 48 are preferably formed of a relatively thin yet high strength material, the difference in the maximum length "L" of the container 10 when the cover 48 is attached to the housing (FIG. 1) and when the cover 48 is removed from the housing (FIG. 7) is small. In the present embodiment, the maximum length "L" of the container 10 is preferably no greater than approximately 90 mm or approximately three and one half ($3^{1/2}$) inches. This dimensioning is necessary to assure that the container 10 fits in certain sized flat-rate packages. However, it is understood by those of ordinary skill in the art that the container 10 is not limited to this exact dimensioning.

In the present embodiment, the cover 48 is sized and shaped to receive and/or enclose the insert segment 18. Specifically, the planes defined by the front and rear sidewalls 50, 52 of the cover 48 are spaced-apart at a predetermined distance that is generally equal to or slightly greater than the predetermined distance between the planes defined by the front and rear sidewalls 20, 22 of the base segment 16. Thus, the maximum thickness "T" between an exterior surface of the front sidewall 50 of the cover 48 and an exterior surface of the rear sidewall 52 of the cover 48 is generally equal to that defined by the exterior surfaces of front and rear sidewalls 20, 22 of the base segment 16. Additionally and/or alternatively to the label(s) described above, the container 10 may also include a tamper resistant (T.R.) label (not shown) that covers a portion of both the base segment 16 and the cover 48 in the first or storage position (FIGS. 1-4).

As seen in FIGS. 1 and 3-5, the cover 48 preferably includes an aperture or opening 62 formed in a sidewall thereof. In the present embodiment, the aperture 62 is preferably formed in the left sidewall 56 of the cover 48. However, it is understood by those skilled in the art that the aperture 62 could be formed in any sidewall 50, 52, 54, 56 of the cover 48 and/or the first end 58 of the cover 48. Alternatively, an aperture (not shown) may be formed in a sidewall 32, 34, 36, 38 of the insert segment 18. The cover 48 may even include two or more apertures (not shown), but the cover 48 is not limited to the inclusion of one or more apertures. A tamper-resistant layer or foil (not shown) may be placed over the aperture 62 after filling the container 10 at the packaging facility. For example, such a layer may be attached by adhesive or friction-fitted to a portion of the cover 48 that surrounds the aperture 62.

Referring to FIGS. 1-5, a locking mechanism 64 is preferably attached to at least one of the housing 12, such as the base segment 18, and the cover 48. In the present embodiment, the locking mechanism 64 includes a flexible tab or living hinge pivotably attached to the cover 48 proximate the second end 60. Specifically, the flexible tab is rectangular in shape when viewed from the side (FIG. 3) and extends from and/or below the second end 60 of the cover 48 by a link member 66. The flexible tab is preferably biased in the locking position. In operation, depressing a first or proximate portion 76 of the flexible tab toward the housing 12 causes a second or distal portion 78 of the flexible tab to pivot away from the base segment 16 of the housing 12. Although not shown, the locking mechanism 64 may include two flexible tabs, one pivotably attached to the right sidewall 54 of the cover 48 proximate the second end 60 and a second pivotably attached to the left sidewall 56 of the cover 48 proximate the second end 60.

Figure 9:
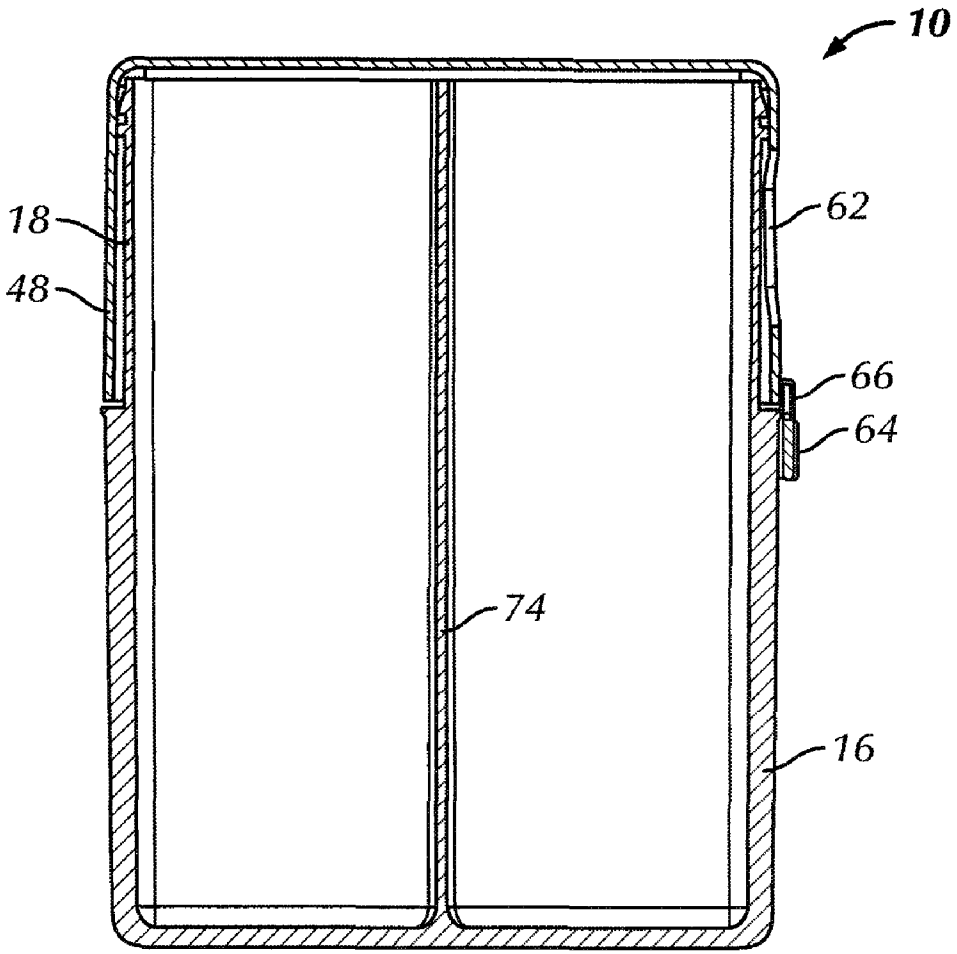
FIG. 9 is a cross-sectional elevation view of a modified version of the container shown in FIG. 1, with a cover of the container shown in the first or storage position.

As seen in FIGS. 5-8, the housing 12 preferably includes a locking groove or notch 68 that is sized, shaped and located to receive at least a portion of the locking mechanism 64. Specifically, in the present embodiment, both the right and left sidewalls 24, 26 of the base segment 16 include a locking groove 68 proximate to and/or just below the first end 28 of the base segment 16. In the present embodiment, each locking groove 68 includes a first or horizontal portion 70 that extends generally horizontally and/or generally parallel to the lip 40 and a second or vertical portion 72 that extends generally vertically and/or perpendicularly from one end of the first portion 70. In addition, a tab 80 preferably extends generally perpendicularly from the right and left sidewalls 24, 26 of the base segment proximate the locking groove 68. In the preferred embodiment, the tab 80 provides additional structure for the flexible tab of the locking mechanism 64 to engage. FIG. 9 shows the embodiment where the container 10 includes only a single locking mechanism and locking groove 68. In another preferred embodiment of the present invention, a raised ridge (not shown) preferably extends around the entire perimeter of the insert segment 18 or base segment 16 proximate to or just above the lip 40. The raised ridge is preferably engaged by sliding at least a portion of the cover 48 over the raised ridge. The raised ridge preferably provides a "snap fit" feature and may be used in lieu of or in addition to the above-described child-resistant feature.

As seen in FIG. 2, a maximum width "W" of the container 10 is generally defined between an exterior surface of the right sidewall 54 of the cover 48 and an exterior surface of the left sidewall 56 of the cover 48. It is understood by those skilled in the art that since tab(s) 80 is/are relatively small compared to the width of the front and rear sidewalls 50, 52 of the container 10, the difference in the maximum width "W" of the container 10 that includes the tab(s) 80 and the maximum width "W" of the container 10 without the tab(s) 80 is small. In the present embodiment, the maximum width "W" of the container 10 is preferably no greater than approximately 70 mm or two and three fourth ($2^{3/4}$) inches. This dimensioning is necessary to assure that the container 10 fits in certain sized flat-rate packages. However, it is understood by those of ordinary skill in the art that the container 10 is not limited to this exact dimensioning.

In operation, the cover 48 is movable, and preferably slidable, between a first, storage or closed position (FIGS. 1-4), in which the aperture 62 is substantially blocked by a sidewall 32, 34, 36, 38 of the insert segment 18 to prevent the at least one item stored/held within the storage cavity 14 from being dispensed through the aperture 62 and from the container 10, and a second, dispensing or open position (FIG. 5), in which the aperture 62 is at least partially open to allow the at least one item stored/held within the storage cavity 14 to be dispensed out of the open top end 42 of the insert segment 18 and through the aperture 62 and from the container 10. The slidable, but preferably not removably, feature of the cover 48 provides the user with greater control of the size of the aperture 62 when dispensing at least one item therefrom.

As understood by those of ordinary skilled in the art, the locking mechanism 64 generally locks the cover 48 in the first position (FIGS. 1-4) and provides the child-resistant feature of the container 10 such that the user must depress one or both locking mechanisms 64 (depending on the particular embodiment), generally with a thumb and index finger, and then slide the cover toward the second position (FIG. 5) to dispense the contents from within the container 10. Further, as understood by those skilled in the art, the protuberance 44 of the insert segment 18 generally prevents the cover 48 from being inadvertently removed from the insert segment 18 in the second position (FIG. 5).

An inside surface of one of the sidewalls 50, 52, 54, 56 of the cover 48 may include a complimentary hook or catch (not shown) to engage the protuberance 44 of the insert segment 18. Of course, it is likely that the cover 48 could be removed from the insert segment 18 if the user so desired, but it is likely that at least a portion of the container 10 would be destroyed, deformed, or caused to exceed its elastic flow limit in such an event. Further, the combination of the protuberance 44 and the elastomeric member 46 generally forms a moisture-tight seal or barrier between the insert segment 18 and the cover 48 in the first position (FIGS. 1-4) such that the container 10 preserves the contents therein and is capable of properly holding/storing liquids. As an alternative to the elastomeric member 46 and protuberance 44, in another preferred embodiment of the present invention, a pliable insert (not shown) is preferably fitted into the inside of the cover 48, so that when the cover 48 is in the closed position a tight fit is created between the cover 48 and the insert segment 18, which preferably compresses the pliable insert to form a moisture or vapor barrier.

As seen in FIG. 6, the housing 12 may include a rib 74, which generally connects an inner surface of the front sidewalls 20, 32 of the base and insert segments 16, 18 to the rear sidewalls 22, 34 of the base and insert segments 16, 18. The rib 74 provides increased stiffness to the housing 12 during the forming of the container 10. Preferably, the rib 74 defines a plane that is spaced a predetermined distance apart from and generally parallel to each of the planes defined by the right and left sidewalls 24, 36, 26, 38 of the base and insert segments 16, 18, respectively. As seen in FIG. 9, the rib 74 may extend the entire length within storage cavity 14 or the interior of the housing 12, such that the rib 74 extends from the second end 30 of the base segment 16 to the first end 42 of the insert segment 18. However, it is understood by those skilled in the art that the housing 12 is not limited to the inclusion of a stiffening rib 74 and the stiffening rib 74 may be modified in size, shape and/or location. Specifically, the rib 74 may be spaced a predetermined distance away from one or both of the first end 42 of the insert segment 18 and the second end 30 of the base segment 16. Alternatively, the rib 74 may be located on the exterior surface one or more of at least a portion of the sidewalls of the base segment 16 and/or insert segment 18 to help keep the housing 12, and thus the storage cavity 14, generally uniform during the forming process.

Furthermore, the above-identified features of the container 10 provide for a method of shipping, packaging and/or transporting at least one, and preferably two or more, child-resistant containers via a postal carrier or service, such as the U.S. Postal Service, Fed-Ex or UPS. The method comprises the steps of providing one and preferably at least two child-resistant containers 10 and obtaining/constructing a flat-rate shipping package allowed and/or approved by a postal carrier. The term "flat-rate shipping package" is defined herein as any packaging approved, allowed, provided and/or sold by a postal carrier in which the carrier charges a predetermined rate to ship the package as long as the contents properly fit within the package, irrespective of the weight of the contents.

Next, the at least two medical containers 10 are inserted within an open end of the package such that adjacent right and left sidewalls or top and bottom ends 54, 30 of the containers 10 are generally parallel and/or in abutting contact. Alternatively, the at least two medical containers 10 may be inserted within an open end of the package such that generally the entire front and rear sidewalls of each container 10 is placed in abutting contact with an interior surface of the package. Next, the open end of the package is closed to enclose the at least two containers 10 within the package. Finally, the closed package is given to the postal carrier and a relatively inexpensive and flat-rate fee is paid to ship the package containing the child-resistant containers 10 to an end user or distributer.

In addition, the container 10 of the present invention provides for a method of filling/packing a child-resistant container with at least one item, such as a pharmaceutical product. The method encompasses either automatic or manual filling. The method comprises the steps of providing a child-resistant container, generally as described in detail above. Next, the base segment 16 of the housing 12 is placed onto an assembly or product line. Next, at least one item, such as a pharmaceutical product, is inserted into the storage cavity 14 via the open first end 42 of the insert segment 18 of the housing 12. Finally, the cover 48 is movably mounted over at least a portion of the insert segment 18 of the housing 12. In an assembled configuration, the container 10 provides a generally air and/or water impermeable container 10 that is capable of storing and/or transporting a variety of pharmaceutical products.

Referring to FIGS. 10-13, a second preferred embodiment of the container 110 is shown, wherein like referenced numerals are utilized to indicate like elements throughout. The reference numerals of the second preferred embodiment are distinguishable from those of the first preferred embodiment by a factor of one hundred (100). The container 110 of the second preferred embodiment is substantially similar to that of the first preferred embodiment. For example, the container 110, having a maximum thickness "T," includes a housing 112, preferably comprised of a base or bottom segment 116 and an insert or top segment 118, and a cover 148 slidably, but not removably, mounted thereto. A protuberance 144 and an elastomeric member 146 are preferably located proximate an upper end of the top segment 118 and preferably extend around an entire periphery thereof.

Figure 13:
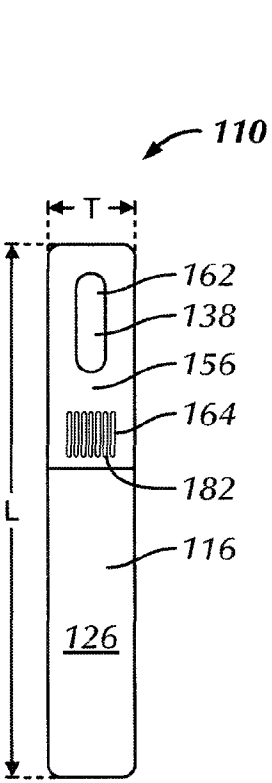
FIG. 13 is a left side elevation view of the child-resistant medicate container shown in FIG. 10, with the cover shown in a first or storage position.
Figure 12:
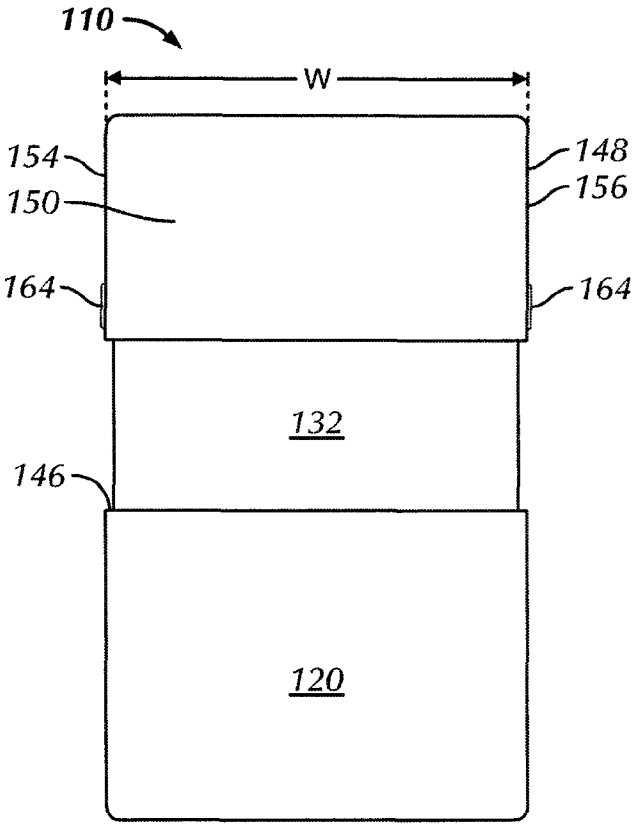
FIG. 12 is a front elevation view of the child-resistant medicate container shown in FIG. 10.
Figure 11:
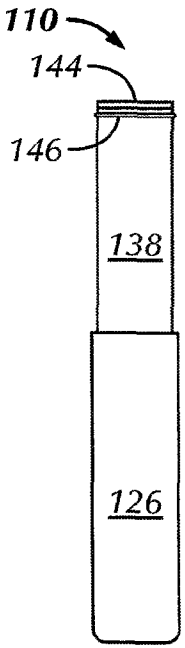
FIG. 11 is a left side elevation view of a housing of the child-resistant medicate container shown in FIG. 10.
Figure 10:
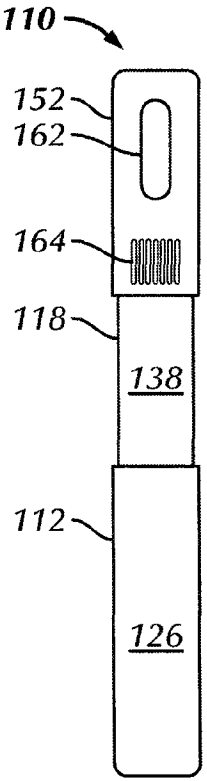
FIG. 10 is a left side elevation view of a child-resistant medicate container in accordance with a second preferred embodiment of the present invention, with a cover of the container shown in a second or dispensing position.

A primary difference between the first and second preferred embodiments is the structure and operation of the locking mechanism 164 of the second preferred embodiment. Specifically, in the present embodiment, the locking mechanism 164 is integrally or fixedly formed with at least one, but preferably both, the right and left sidewalls 154, 156 of the cover 148. An exterior surface of each locking mechanism 164 includes a plurality of spaced-apart ribs 182 that extend generally parallel to the front and rear sidewalls 150, 152 of the cover 148. The plurality of ribs 182 increase the friction between a users thumb/finger and the cover 148 when the user is attempting to slide the cover 148 with respect to the housing 112. In addition, an interior surface of the cover 148 may include a catch or hook (not shown) to generally engage a portion of the housing 112 in the second or storage position (FIG. 13). However, one skilled in the art would understand that the cover 148 and housing 112 may be secured to each other by a variety of other well known fastening methods, such as an interference or friction fit, screws, adhesives or the like. In addition, those skilled in the art will understand from the present disclosure that the locking mechanism 164 may be one of a variety of well known latching devices, such as a slider or a snap without departing from the spirit and scope of the invention.

In operation, the user depresses the locking mechanism 164 toward a geometric center of the container 110, such that the catch or hook of the cover 148 is released from a complimentary ledge or protuberance (not shown) on the housing 112. At this point, the cover 148 is generally freely slidable over at least a portion of the insert segment 118 to either dispense at least one item from the aperture 162 of the cover 148 or safely enclose the at least one item within the container 110.

Figure 14:
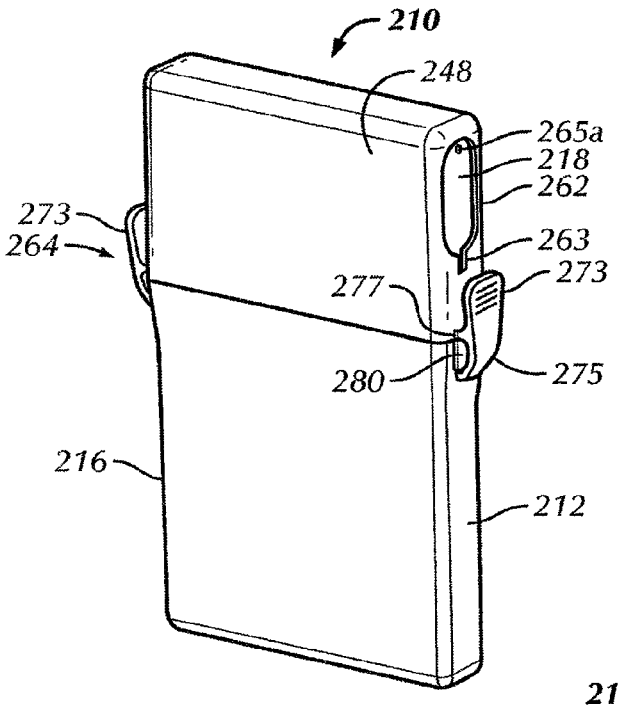
FIG. 14 is a perspective view of a child-resistant medicate container in accordance with a third preferred embodiment of the present invention, with a cover of the container shown in the first or storage position.
Figure 15:
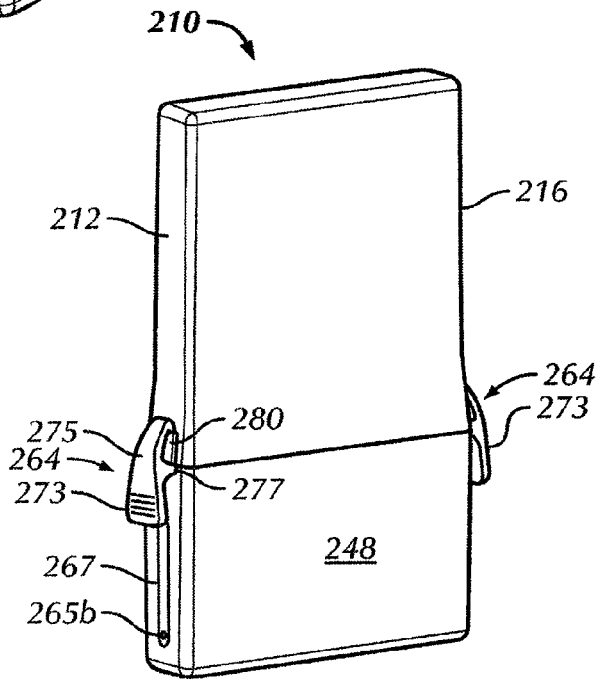
FIG. 15 is a perspective view of the child-resistant medicate container shown in FIG. 14 in an inverted position, with the cover of the container shown in the first or storage position

Referring to FIGS. 14 and 15, a third preferred embodiment of the container 210 is shown, wherein like referenced numerals are utilized to indicate like elements throughout. The reference numerals of the second preferred embodiment are distinguishable from those of the first preferred embodiment by a factor of two hundred (200). The container 210 of the third preferred embodiment is substantially similar to that of the first and second preferred embodiments. For example, the container 210 includes a housing 212, preferably comprised of a base or bottom segment 216 and an insert or top segment 218, and a cover 248 slidably, but not removably, mounted thereto. Additional similarities between the preferred embodiments are omitted herein for the sake of brevity and convenience and is not limiting.

A distinguishing feature of the third preferred embodiment, as compared to the first and second preferred embodiments, is the size, shape and operation of a locking mechanism 264. It is preferred that one of the base segment 216 and the insert segment 218 includes a tab or catch 280 and the other of the base segment 216 and the insert segment 218 includes a gripping portion 273 and a hook portion 275 that are pivotable about a living hinge 277. It is preferred that selective depression of the gripping portion 273 pivots the gripping portion 273, which in turn causes the hook portion 275 to engage or disengage the catch 280.

Further, as shown in FIG. 14, an aperture or opening 262 formed in a sidewall of the cover 248 preferably includes a groove or notch 263 that extends outwardly beyond a periphery of the aperture 262. The groove 263 is preferably sized and shaped to selectively receive a portion of a projection 265*a* that extends outwardly at least slightly beyond a sidewall of the insert segment 18. As shown in FIG. 15, it is preferred that a sidewall of the cover 248 opposite the aperture 262 includes a slot 267 therein that preferably extends completely through the sidewall. The slot 267 is preferably sized and shaped to selectively receive a portion of a projection 265*b* that extends outwardly at least slightly beyond a sidewall of the insert segment 18. The combination of the groove 263 and projection 265*a*, and the slot 267 and projection 265*b*, preferably limit the range of motion or travel of the cover 248 with respect to the housing 212.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A child-resistant medicate container for holding and dispensing at least one pharmaceutical product, the container comprising:

a housing having an open first end and an opposing closed second end, the housing at least partially enclosing a storage cavity, the housing including a top segment fixedly attached to and extending from a bottom segment, a portion of the bottom segment being located proximate the closed second end of the housing and a portion of the top segment being located proximate the open first end of the housing, each of the bottom segment and the top segment including a generally flat first sidewall and an opposing generally flat second sidewall that define the storage cavity, each sidewall defining a plane and each plane extending generally parallel with respect to the remaining planes, the planes defined by the first and second sidewalls of the bottom segment being spaced-apart a greater distance than a distance between the planes defined by the first and second sidewalls of the top segment, the bottom segment including a third sidewall and an opposing fourth sidewall, a central portion of each of the third and fourth sidewalls being generally flat and extending generally perpendicularly to the first and second sidewalls, portions of each of the third and fourth sidewalls on opposing lateral sides of the central portion of each of the third and fourth sidewalls being concave;

a cover movably attached to the housing and surrounding at least a portion of the first and second sidewalls of the top segment of the housing, one of the cover and the top segment of the housing including an aperture formed in a sidewall thereof, the cover being movable between a first position in which the aperture is substantially blocked to prevent the at least one pharmaceutical product from being dispensed from the container and a second position in which the aperture is at least partially open to allow the at least one pharmaceutical product to be dispensed from the container; and a locking mechanism extending outwardly from and pivotally attached to each of two opposing sidewalls of the cover, each locking mechanism including a link member extending downwardly from the cover to below a bottom edge of the cover, wherein selective depression of a first portion of both locking mechanisms toward the bottom portion of the housing pivots a second portion of both locking mechanisms away from the bottom portion of the housing.

2. The child-resistant medicate container according to claim 1 wherein an end of the top segment proximate the first open end of the housing includes a protuberance that extends generally perpendicularly from at least the first and second sidewalls thereof, the protuberance generally preventing the cover from being removed from the top segment in the second position, the protuberance extending around the entire outer periphery of the top segment, and wherein an elastomeric member extends around the entire outer periphery of the top segment adjacent to the protuberance to form a moisture seal barrier when the cover is in the first position.

* * * * *